US008413826B2

(12) United States Patent
Schneider et al.

(10) Patent No.: US 8,413,826 B2
(45) Date of Patent: Apr. 9, 2013

(54) PRODUCT DISPLAY TRAY

(75) Inventors: Raymond M Schneider, Port Washington, NY (US); Richard Jay, Westport, CT (US); Eleanor Lovinsky, Brooklyn, NY (US)

(73) Assignee: Display Technologies, College Point, NY (US)

( * ) Notice: Subject to any disclaimer, the term of this patent is extended or adjusted under 35 U.S.C. 154(b) by 0 days.

(21) Appl. No.: 13/482,447

(22) Filed: May 29, 2012

(65) Prior Publication Data

US 2012/0234779 A1 Sep. 20, 2012

Related U.S. Application Data

(63) Continuation of application No. 12/705,060, filed on Feb. 12, 2010, now Pat. No. 8,186,520, which is a continuation of application No. 11/657,943, filed on Jan. 25, 2007, now Pat. No. 7,703, 614.

(60) Provisional application No. 60/762,984, filed on Jan. 27, 2006, provisional application No. 60/775,034, filed on Feb. 21, 2006.

(51) Int. Cl.
*A47F 5/00* (2006.01)

(52) U.S. Cl.
USPC ..... 211/184; 211/126.1

(58) Field of Classification Search ..... 211/59.3, 211/59.2, 184, 175, 189, 126.1, 183
See application file for complete search history.

(56) References Cited

U.S. PATENT DOCUMENTS

| | | | | | |
|---|---|---|---|---|---|
| 4,724,968 | A * | 2/1988 | Wombacher | 211/59.3 |
| 4,907,707 | A * | 3/1990 | Crum | 211/59.3 |
| 5,366,099 | A * | 11/1994 | Schmid | 211/59.3 |
| 5,367,606 | A | 11/1994 | Moslehi et al. | |
| 5,458,248 | A * | 10/1995 | Alain | 211/175 |
| 5,634,564 | A * | 6/1997 | Spamer et al. | 211/59.3 |
| 5,746,328 | A * | 5/1998 | Beeler et al. | 211/59.3 |
| 6,142,317 | A * | 11/2000 | Merl | 211/59.3 |
| 6,357,606 | B1 * | 3/2002 | Henry | 211/59.3 |
| 6,622,874 | B1 * | 9/2003 | Hawkinson | 211/59.3 |
| 6,691,891 | B2 * | 2/2004 | Maldonado | 221/279 |
| 6,866,156 | B2 * | 3/2005 | Nagel et al. | 211/59.3 |
| 6,955,269 | B2 * | 10/2005 | Menz | 211/59.3 |
| 7,168,579 | B2 * | 1/2007 | Richter et al. | 211/59.3 |
| 7,458,473 | B1 * | 12/2008 | Mason | 211/59.3 |
| 7,703,614 | B2 * | 4/2010 | Schneider et al. | 211/59.3 |
| 8,186,520 | B2 * | 5/2012 | Schneider et al. | 211/59.3 |
| 2003/0217980 | A1 * | 11/2003 | Johnson et al. | 211/59.3 |
| 2006/0186065 | A1 * | 8/2006 | Ciesick | 211/59.3 |
| 2007/0090068 | A1 * | 4/2007 | Hardy | 211/59.3 |
| 2007/0170127 | A1 * | 7/2007 | Johnson | 211/59.3 |

* cited by examiner

*Primary Examiner* — Jennifer E. Novosad
(74) *Attorney, Agent, or Firm* — Carter, DeLuca, Farrell & Schmidt, LLP

(57) ABSTRACT

A product display tray configured for use on a shelf is disclosed. The product display tray includes a base and at least one side wall. The base includes a front end, a back end, a left side, a right side, a lower surface and an upper surface for supporting items. The side wall is selectively positionable a distance from a side of the base and is substantially parallel to the side.

13 Claims, 17 Drawing Sheets

PRODUCT DISPLAY TRAY

CROSS REFERENCE TO RELATED APPLICATIONS

The present application claims the benefits of, priority to, and is a Continuation of U.S. Pat. No. 8,186,520, filed on Feb. 12, 2010, which claims the benefits of, priority to, and which is a Continuation of U.S. Pat. No. 7,703,614, filed on Jan. 25, 2007, which claims the benefits of and priority to provisional application Ser. No. 60/762,984 filed on Jan. 27, 2006 and titled SPRING-LOADED DISPLAY TRAY, by Raymond M. Schneider, et al. and provisional application Ser. No. 60/775,034 filed on Feb. 21, 2006 and titled SPRING-LOADED DISPLAY TRAY, by Raymond M. Schneider, et al. The entire contents of each of these applications are hereby incorporated in their entirety herein.

BACKGROUND

The present disclosure relates to a display tray, and more particularly, to a product display tray including a base and at least one adjustable side wall.

Typically, various shelves in a supermarket, grocery store or the like are disposed in a downward and forward orientation so that an entire column of products (i.e., the product train) will slide forwardly and downwardly under the influence of gravity to the front of the shelf (where it is usually blocked by an upstanding ledge or stop). Where the friction of the product train on the shelf floor is too high for such movement of the product train under the influence of gravity alone, a pusher is often used to drive the rear of the product train forwardly and/or downwardly.

Additionally, it is frequently desirable to employ product display trays that facilitate alignment of similar product items in a front-to-back column, neatly aligned and presenting an attractive display to the customer. Inasmuch as different product items occupy different amounts of space on the display trays or shelves, it may be desirable for a product display tray to accommodate width adjustment, so that narrow packages can be aligned in a narrow column and wider packages in a wider column.

SUMMARY

The present disclosure relates to a product display tray configured for use on a shelf. The product display tray includes a base and at least one side wall. The base includes a front end, a back end, a left side, a right side, a lower surface and an upper surface for supporting items. The side wall is selectively positionable a distance from a side of the base and is substantially parallel to the side.

DETAILED DESCRIPTION

Figure 1:
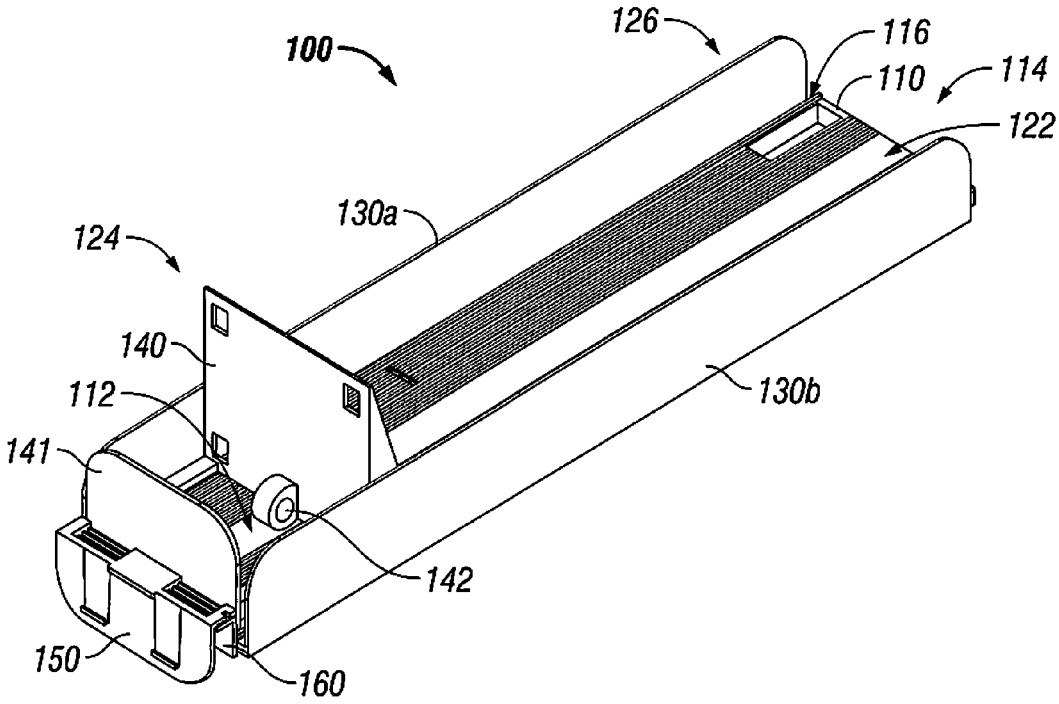
FIG. 1 illustrates a perspective view of a product display tray in accordance with an embodiment of the present disclosure.
Figure 2:
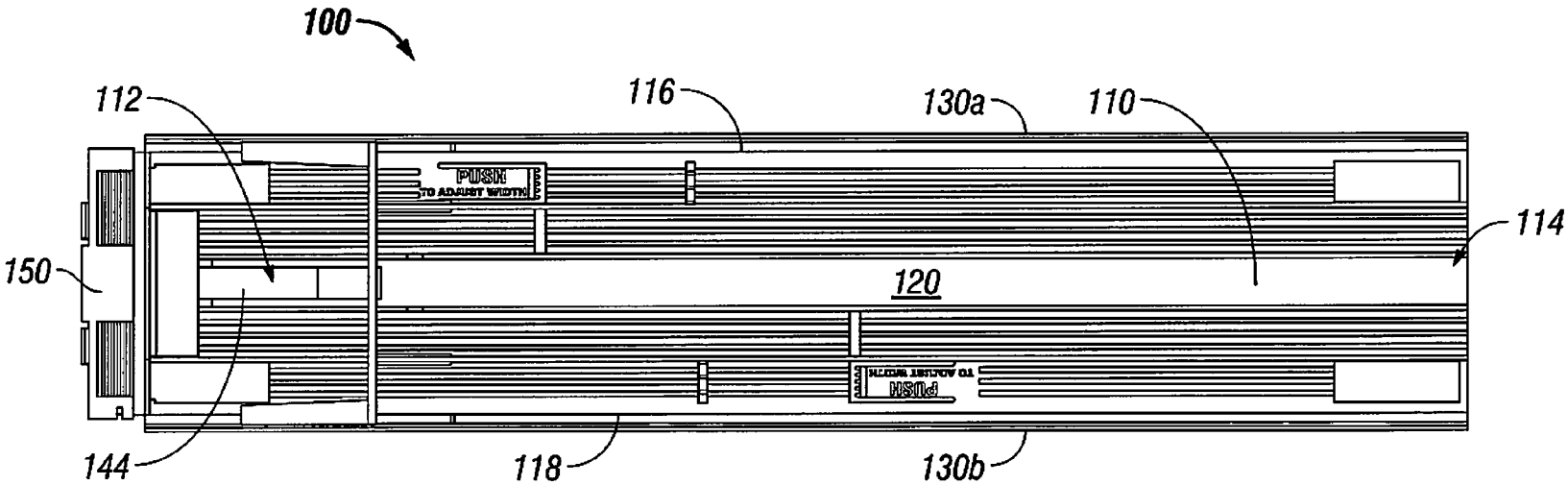
FIG. 2 illustrates a top view of the product display tray of FIG. 1.

Embodiments of the presently disclosed product display tray are now described in detail with reference to the drawings, in which like reference numerals designate identical or corresponding elements in each of the several views. As used herein the term "distal" refers to that portion of the product display tray, or component thereof, farther from a user, while the term "proximal" refers to that portion of the product display tray, or component thereof, closer to the user.

Various embodiments of a product display tray are illustrated in FIGS. 1-18 and are generally referenced by numeral 100. Product display tray 100 is generally configured for use on a shelf 200 and includes a base 110 and at least one side wall 130. The side wall 130 is selectively positionable a distance from a portion of base 110.

Referring specifically to FIGS. 1-4, base 110 includes a front end 112, a back end 114, a left side 116, a right side 118, a lower surface 120 and an upper surface 122 for supporting items or products. Additionally, FIGS. 1-4 illustrate a pair of side walls 130*a* and 130*b*, each being adjacent a respective side 116, 118 of base 110. As is described in detail below, it is envisioned that each side wall 130*a*, 130*b* is positionable a distance from base 110 (e.g., with an arm 132*a*, 132*b*) to facilitate the accommodation of items of different sizes, for example. As can be appreciated, adjustable side walls 130*a*, 130*b* allow product display tray 100 to be used for a variety of products. For example, once products have been emptied from product display tray 100, at least one side wall 130 may be positioned closer to or farther from base 110 to allow for the loading of other products having a different width.

Figure 3:
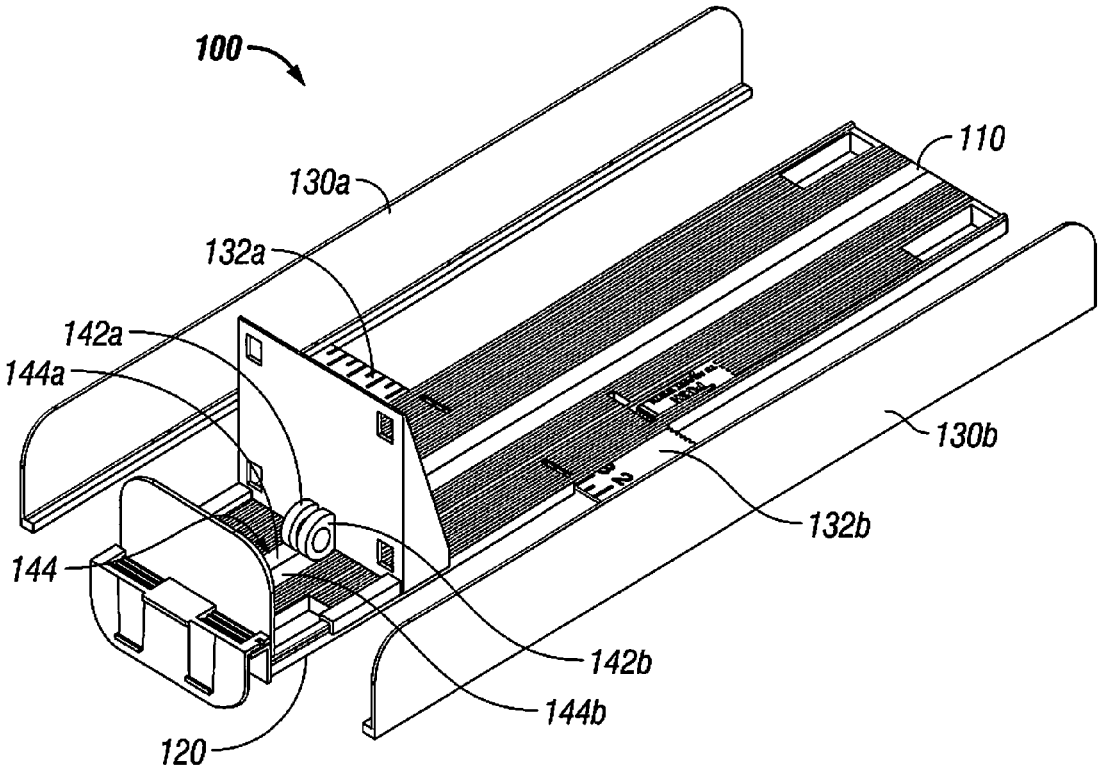
FIG. 3 illustrates a perspective view of a product display tray with the side walls in a partially extended position in accordance with an embodiment of the present disclosure.
Figure 4:
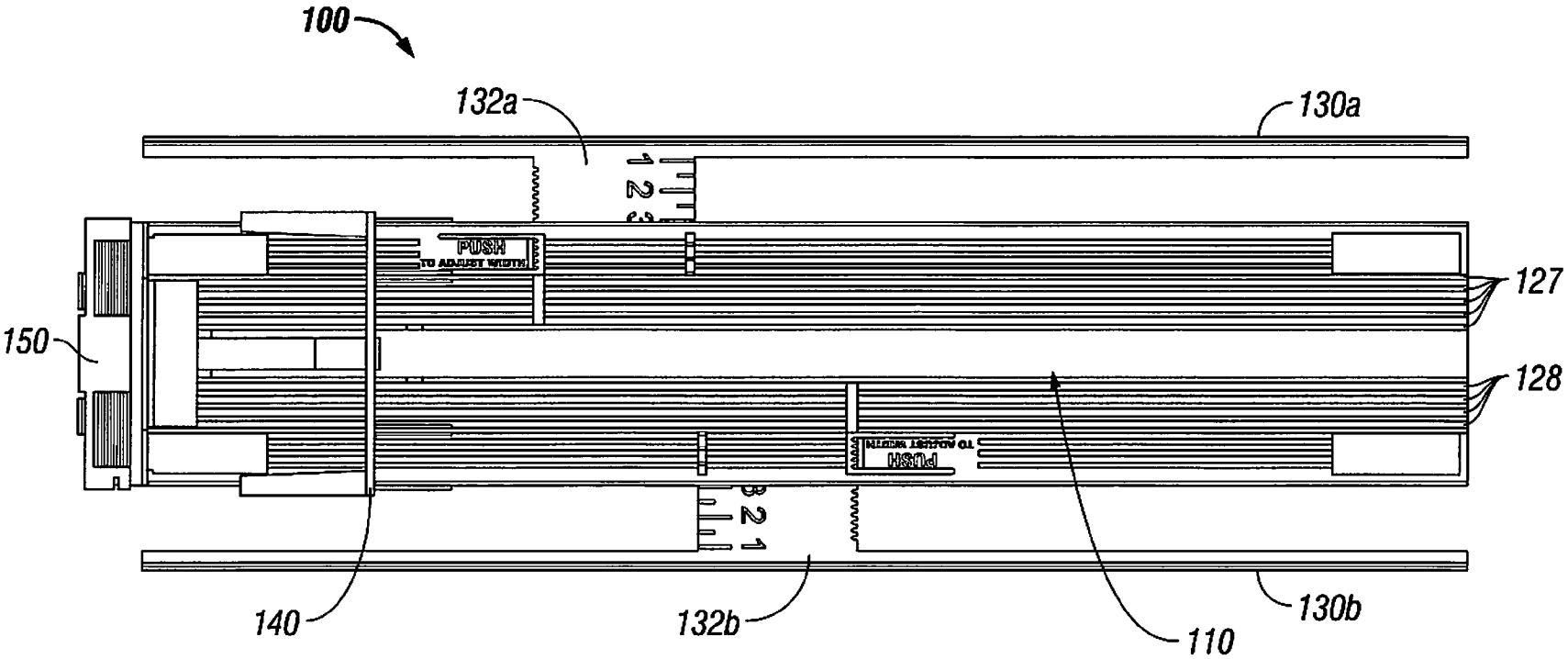
FIG. 4 illustrates a top view of the product display tray of FIG. 3.
Figure 19:
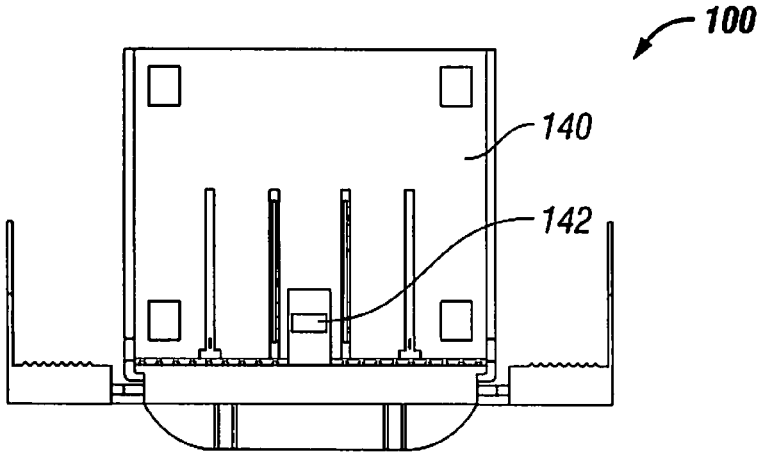
FIG. 19 illustrates a rear view of a pusher for use with a product display tray in accordance with an embodiment of the present disclosure.

A pusher 140 is also illustrated in FIGS. 1-4. In the illustrated embodiments, pusher 140 is slidably disposed adjacent upper surface 122 of base 110. Pusher 140 is configured to urge a product 300 (FIG. 6) or row of products proximally towards front end 112 of base 110. It is envisioned that at least one biasing element 142 (e.g., a spiral spring or coil spring) (a pair of biasing elements 142*a* and 142*b* is shown in FIG. 3) is disposed in mechanical cooperation with pusher 140 to bias pusher 140 proximally. It is envisioned that biasing element 142 is positioned proximally of pusher 14 (e.g., see FIG. 1) or distally of pusher 140 (e.g., see FIG. 19). More specifically, a proximal portion of biasing element 142 may be secured to a proximal portion 124 of base 110 and a distal portion of biasing element 142 may be secured to pusher 140. Further, at least one track 144 (a pair of tracks 144*a* and 144*b* is shown in FIG. 4) may be provided for biasing element 142 to travel along without interfering with the placement or movement of products 300, for instance. It is also envisioned that biasing element is secured to pusher 140 and to a distal portion 126 of base 110. In an embodiment, pusher 140 is distally movable and lockable in a distal position, e.g., to re-stock product display tray 100, by moving pusher 140 distally against force exerted by biasing element 142. Further, a stop 141 is shown adjacent front end 112 of base 110 to prevent products 300 from being pushed proximally off base 110.

FIGS. 1-4 also illustrate a plurality of ribs 127 (e.g. raised above upper surface 122) disposed in substantially parallel rows between front end 112 and back end 114 of base 110. It is envisioned that ribs 127 help reduce friction between base 110 and products 300 thereon to facilitate sliding products 300 across product display tray 100. Additionally, channels 128 are formed between adjacent ribs 127. Channels 128 may function to direct liquid (e.g., water that melted from frozen food packages) towards front end 112 (e.g., in gravity-fed embodiments) or back end 114 of base 110. Thus, channels 128 may also facilitate the ease of sliding products 300 across product display tray 100.

Figure 5:
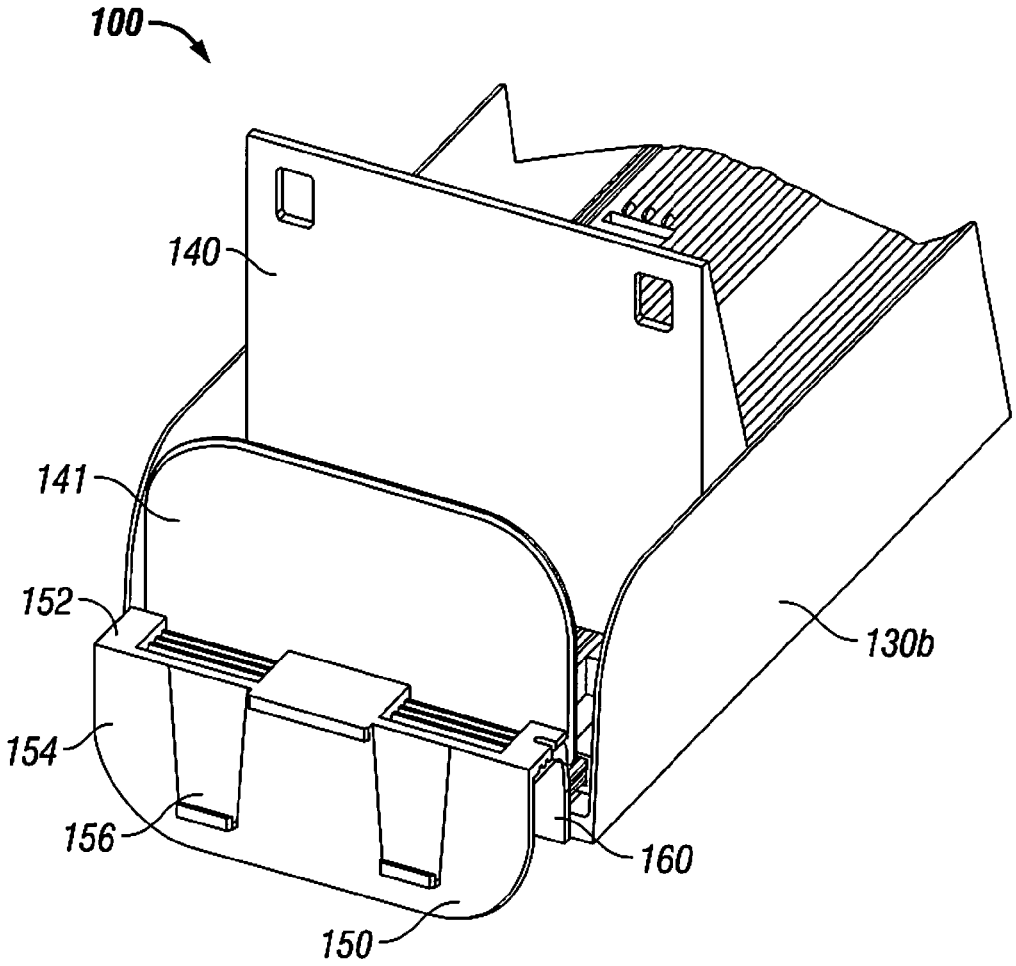
FIG. 5 illustrates a partial perspective view of a handle portion of the product display tray in accordance with an embodiment of the present disclosure.
Figure 6:
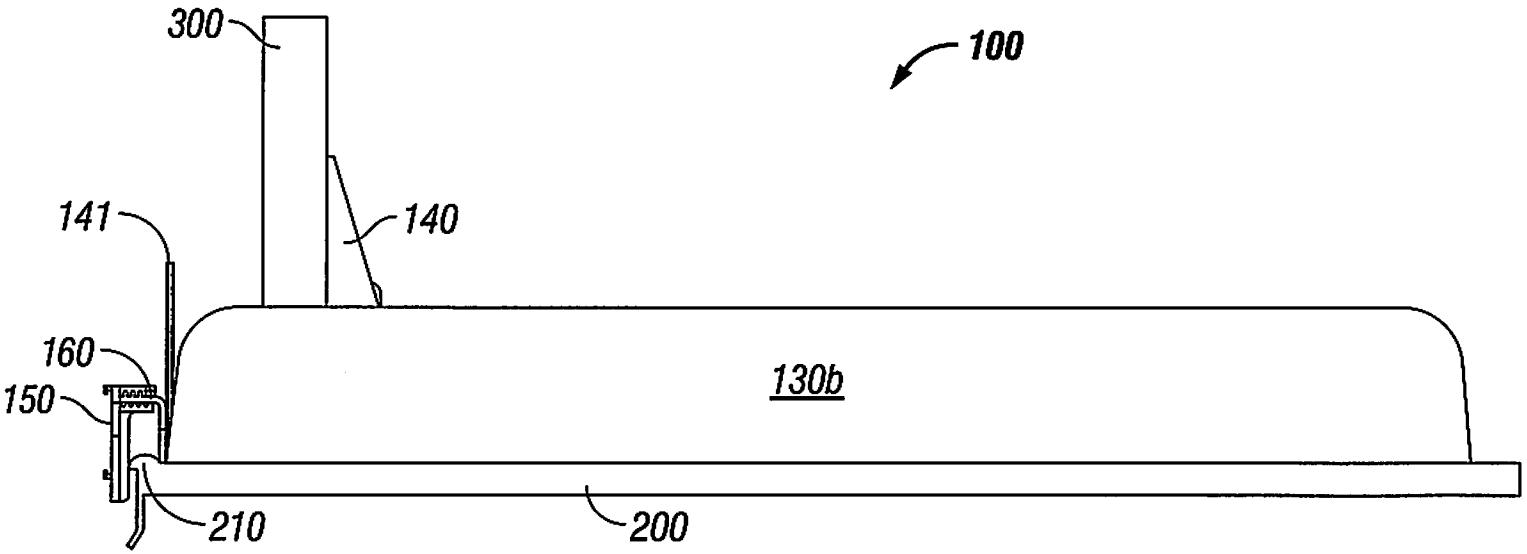
FIG. 6 illustrates a side view of the product display tray of FIG. 5 positioned on a shelf.

With reference to FIGS. 5 and 6, a handle 150 of product display tray 100 is shown. An enlarged view of front end 112 of product display tray 100 having handle 150 is illustrated in FIG. 5. In FIG. 6, product display tray 100 is positioned on shelf 200, in accordance with an embodiment of the present disclosure. In this embodiment, handle 150 is configured to engage a shelf lip 210 at a proximal portion of shelf lip 210. Further, a base lip 160 is configured to engage a distal portion of shelf lip 210. Thus, shelf lip 210 is essentially captured between handle 150 and base lip 160.

When shelf lip 210 is captured, product display tray 100 is secured in position on shelf 200 and resists moving out of position (i.e., proximally or distally). For example, when products 300 are loaded onto product display tray 100, distal movement of product display tray 100 is opposed. Distal movement of product display tray 100 is also resisted when pusher 140 is pushed distally, e.g., to re-stock product display tray 100. Proximal movement of product display tray 100 (e.g., product display tray 100 moving off shelf 200) is resisted, for instance, when a consumer pulls product 300 proximally off shelf 200.

With continued reference to FIGS. 5 and 6, handle 150 is illustrated as having a substantial "L" shape, including a substantially horizontal portion 152 and a substantially vertical portion 154. Vertical portion 154 is shown downwardly depending from horizontal portion 152 and extending beneath lower surface 120 of base 110. In such an embodiment, a user may grab handle 150 to facilitate moving product display tray 100, e.g., moving into or out of a freezer. Further, vertical portion 154 of handle 150 is shown with a securing element 156, which allows a UPC label or other product information to be visibly displayed on product display tray 100.

Figure 7:
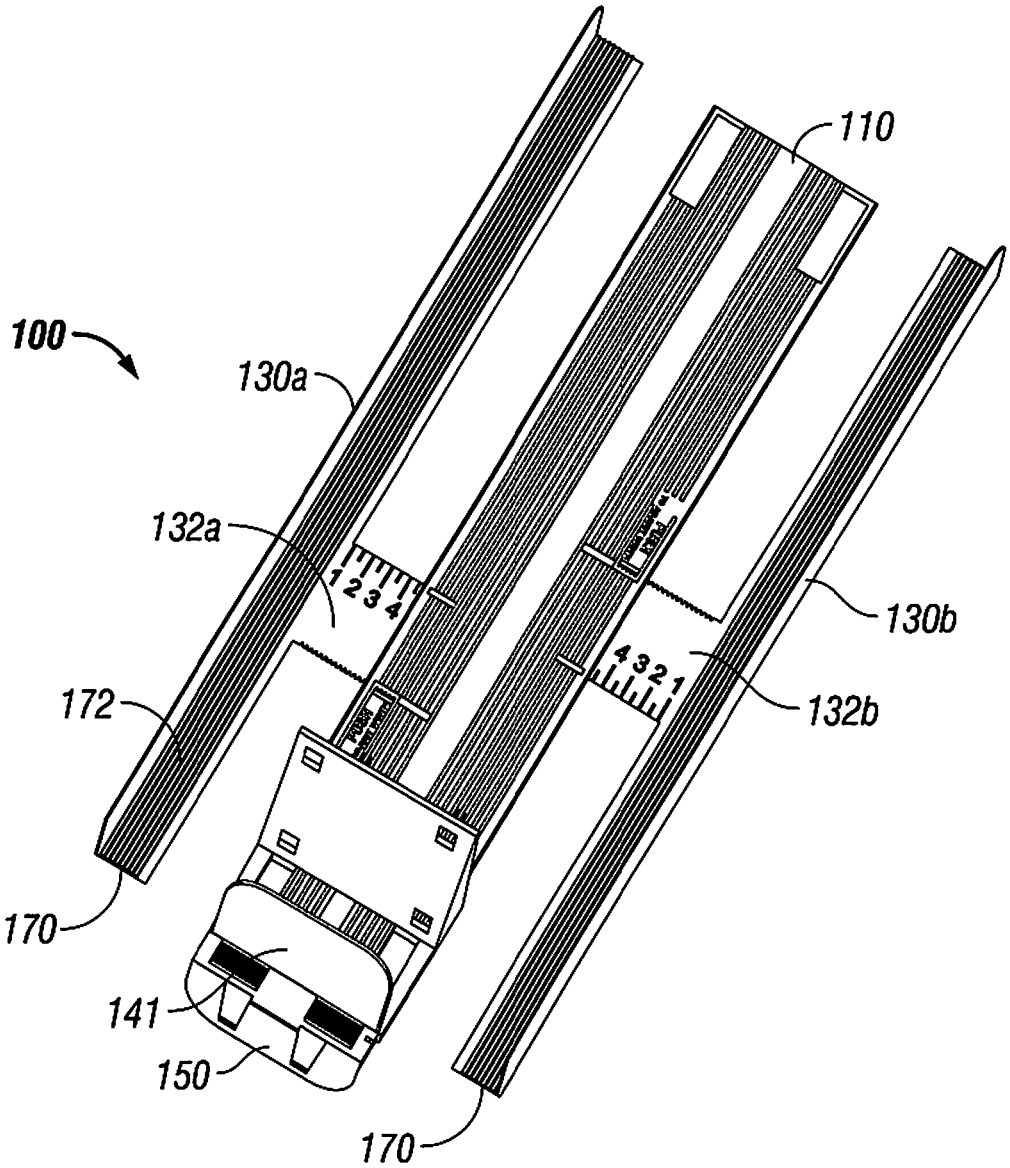
FIG. 7 illustrates a perspective view of a product display tray with the side walls in a partially extended position and including a ledge in accordance with an embodiment of the present disclosure.
Figure 8:
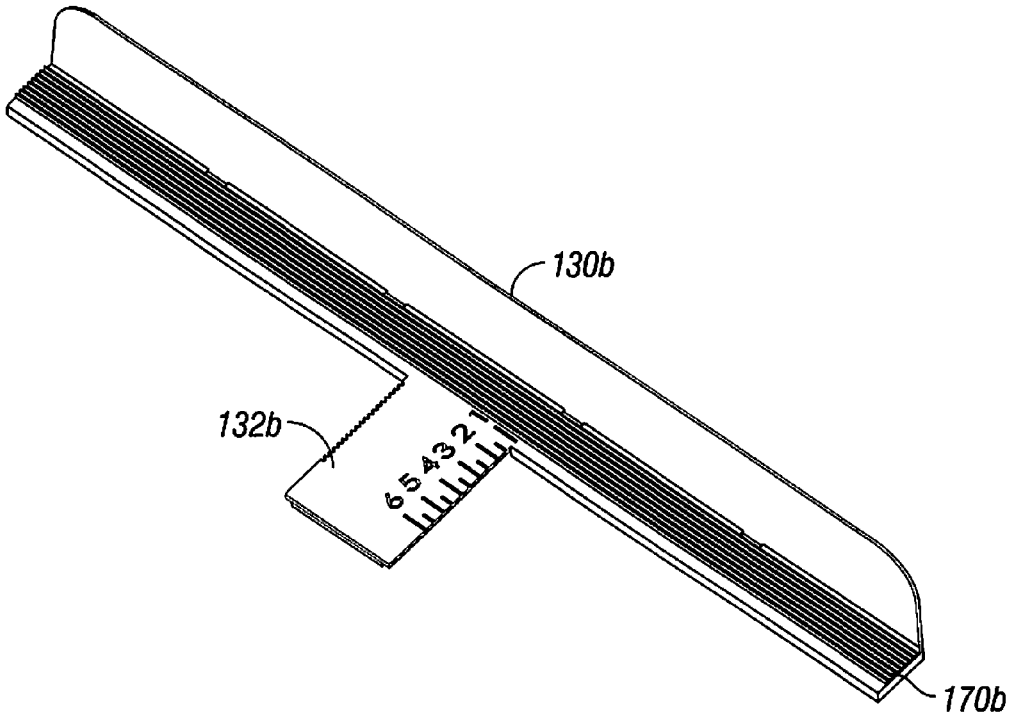
FIG. 8 illustrates a perspective view of a side wall including a ledge and an arm in accordance with an embodiment of the present disclosure.
Figure 8A:
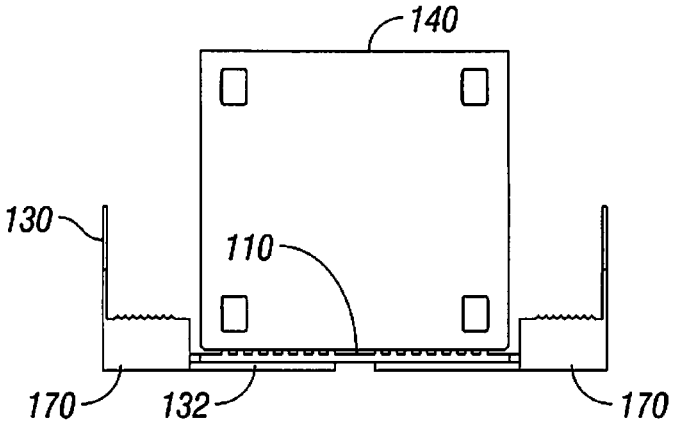
FIGS. 8A-8C illustrate cross-sectional views of product display trays in accordance with various embodiments of the present disclosure.
Figure 8B:
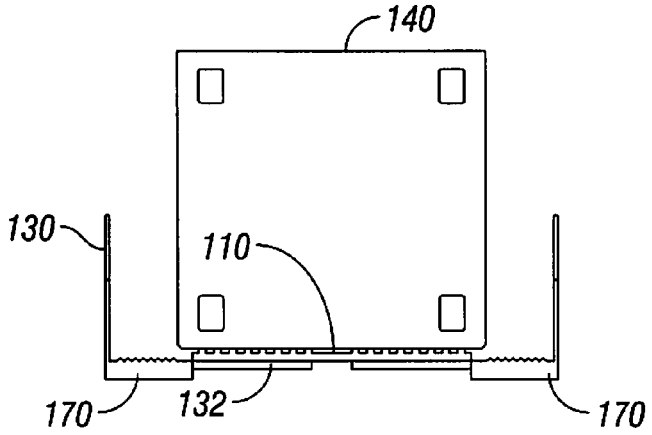
Figure 8C:
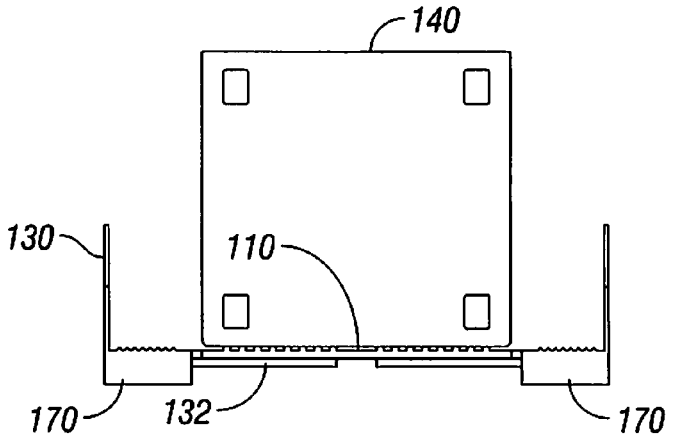

FIGS. 7 and 8 illustrate an embodiment of product display tray 100 including a ledge 170 in mechanical cooperation with each side wall 130. In particular, FIG. 8 shows side wall 130*b* having ledge 170*b* and arm 132*b*. Ledge 170 extends from side wall 130 towards base 110 and provides a surface for products 300 to travel across and/or rest on. It is envisioned that at least a portion of ledge 170 is above the height of arm 132 adjacent thereto. In such an embodiment, ledge 170 may help prevent corners or edges of products 300 from being caught on arm 132. Further, a plurality of ledge ribs 172 may be disposed on ledge 170 to help ease the travel of products 300 thereacross, for instance. With specific reference to FIGS. 8A-8C, it is envisioned that a top surface of ledge 170 is disposed above upper surface 122 of base 110 (FIG. 8A), below upper surface 122 (FIG. 8B), or substantially equal to upper surface (FIG. 8C). It is further envisioned that ledge 170 of each side wall 130 is disposed at a different height relative to upper surface 122 and that the height of ledge 170 is adjustable.

Figure 9:
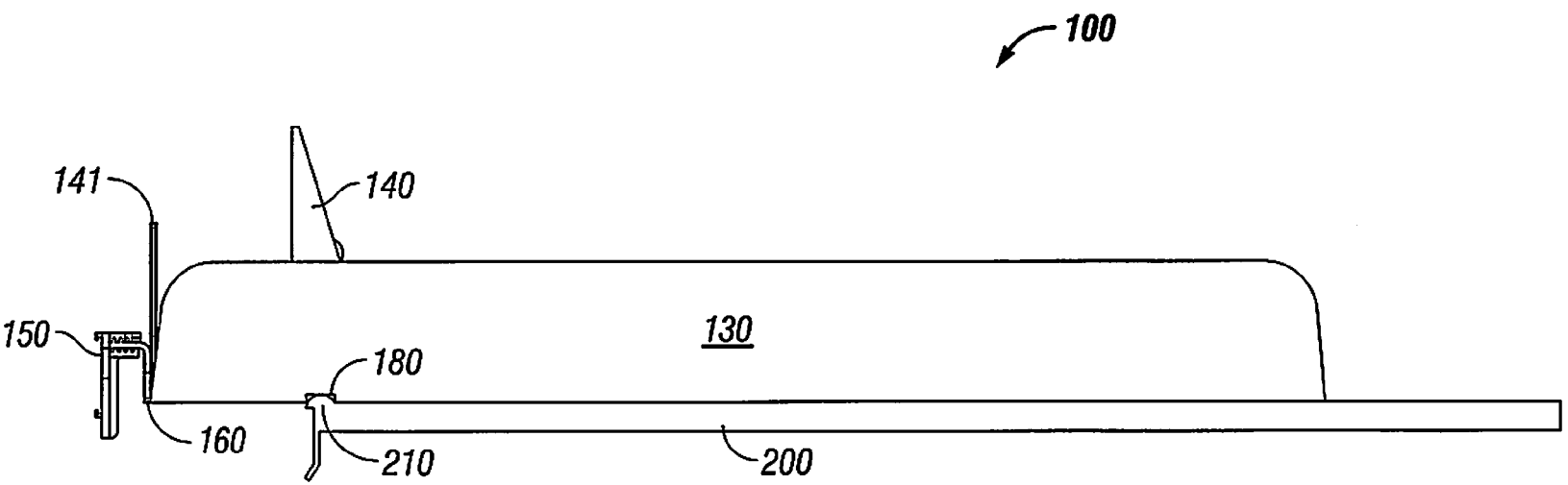
FIG. 9 illustrates a side view of a product display tray having a notch and positioned on a shelf in accordance with an embodiment of the present disclosure.
Figure 10:
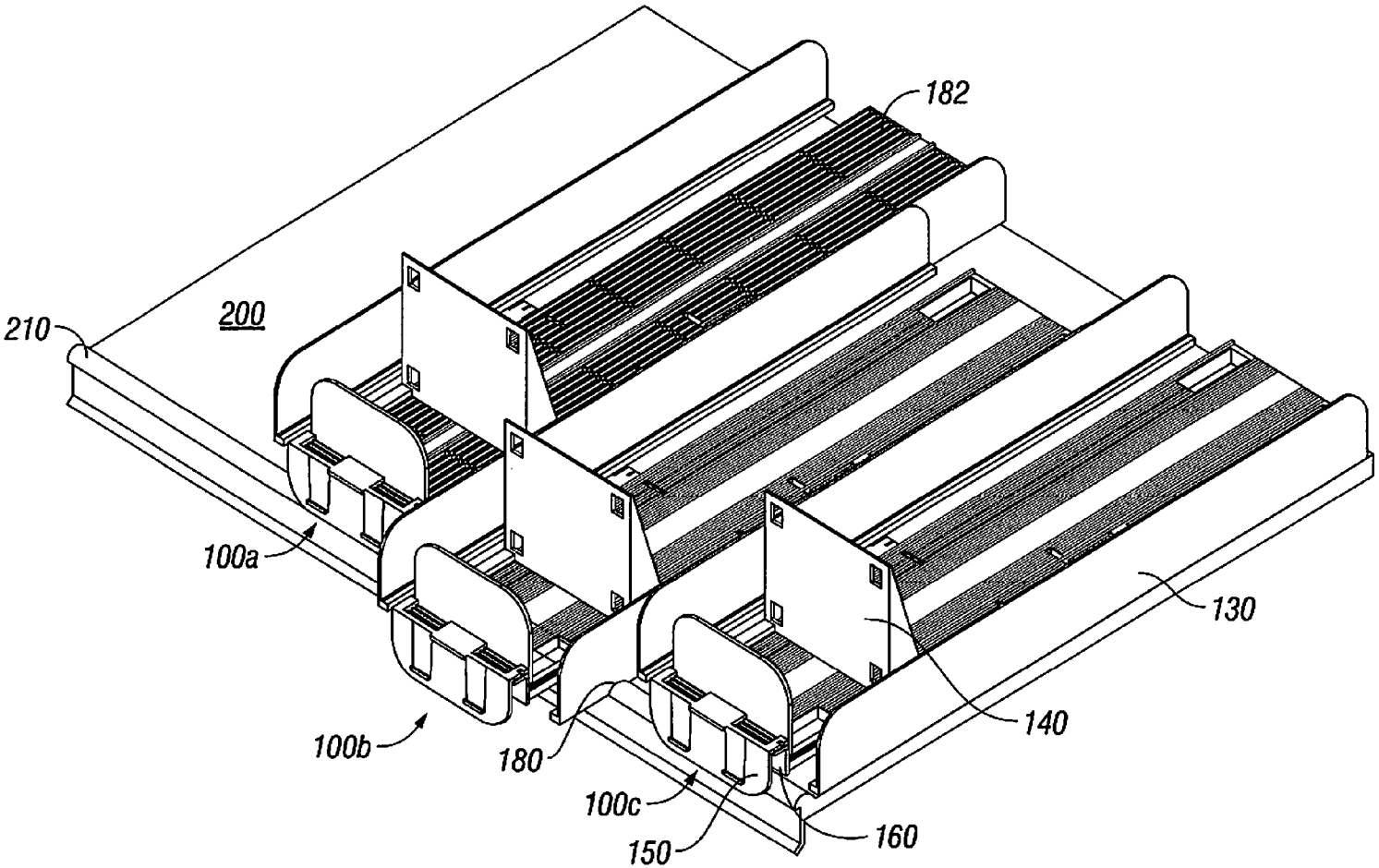
FIG. 10 illustrates a perspective view of three product display trays positioned on a shelf in accordance with an embodiment of the present disclosure.

Referring to FIGS. 9 and 10, product display tray 100 is shown having a notch 180 therein. It is envisioned that notch 180 is disposed on side wall 130 and/or base 110 and is configured to engage shelf lip 210. As shown, product display tray 100 may be positioned on shelf 200 such that front end 112 of base 110 extends proximally of shelf lip 210. FIG. 10 illustrates three product display trays 100*a*, 100*b* and 100*c*. Two product display trays 100*a* and 100*c* are shown with handle 150 engaging shelf lip 210, while product display tray 100*b* is shown with notch 180 engaging shelf lip 210. This arrangement may be helpful for loading product display tray 100*b*, for example, helping ensure that adjacent product display trays 100*a*, 100*c* do not interfere.

Additionally, each product display tray 100 may be placed in this position (i.e., with notch 180 engaging shelf lip 210) so products 300 thereon are located closer to a consumer and/or a freezer door, for example. This placement may also discourage the placement of other products hanging on the interior of the freezer door, for example, and blocking the view of products 300 on product display tray 100.

In FIG. 10, product display tray 100*a* is also shown with its base 110 having a plurality of holes 182. It is envisioned that holes 182 may be included on base 110 (and/or side walls 130 and/or pusher 140) to decrease the weight of product display tray 100. As can be appreciated, a lower weight may facilitate loading a product display tray 100, having a plurality of products 300 already thereon, onto shelf 200.

Figure 11:
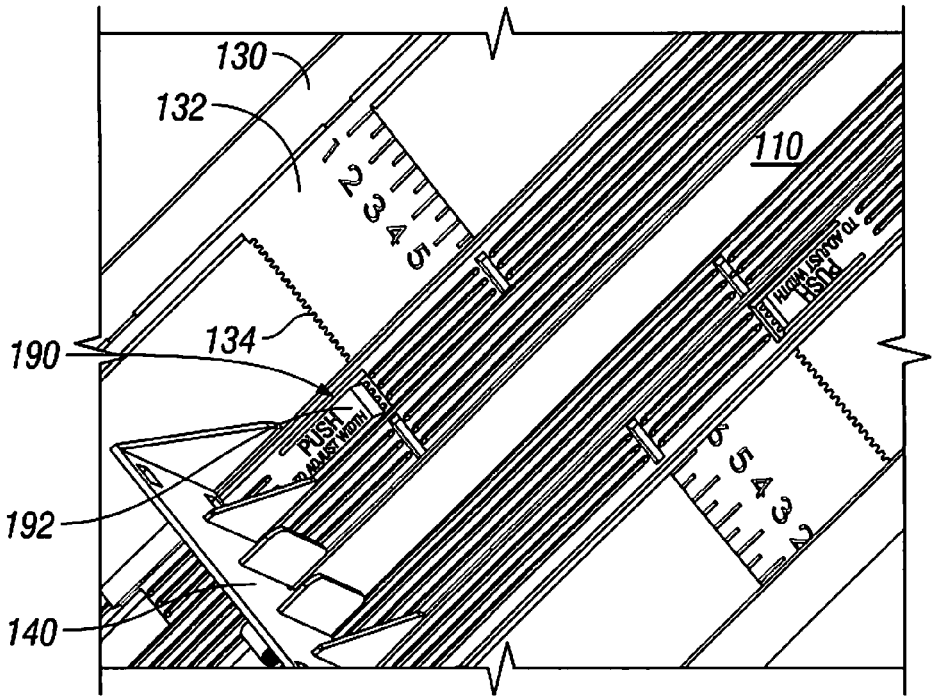
FIGS. 11-13 are enlarged views of a locking portion of a product display tray in accordance with an embodiment of the present disclosure.
Figure 12:
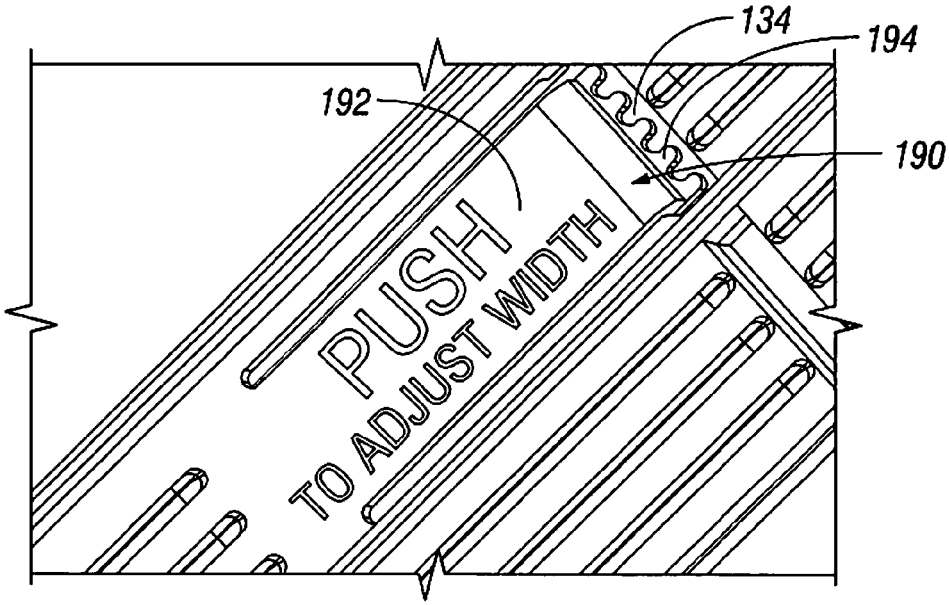
Figure 13:
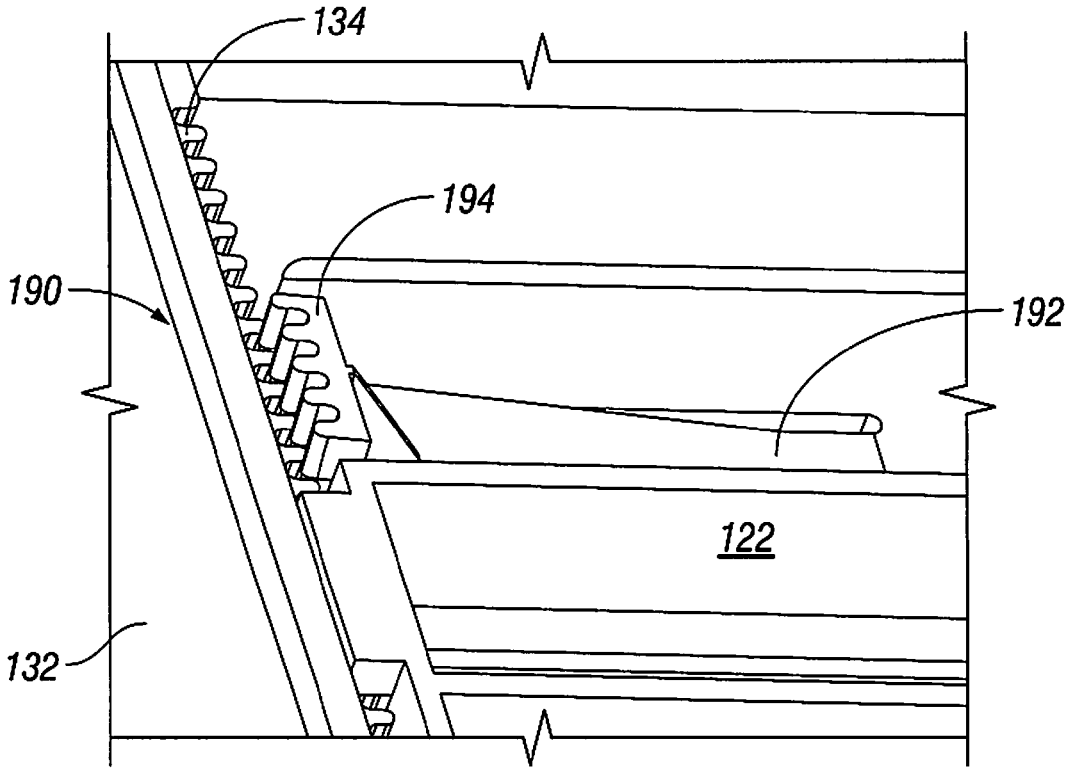

Referring to FIGS. 11-13, a locking mechanism 190 is shown. Locking mechanism 190 helps position and secure side walls 130 in a desired position relative to base 110. In the illustrated embodiment, locking mechanism 190 includes a tab 192 disposed on base 110. Tab 192 includes tab teeth 194, which are configured to engage arm teeth 134 disposed on arm 132. Here, tab 192 is deflectable (above and/or below upper surface 122 of base 110), such that tab teeth 194 can move into and out of engagement with arm teeth 134.

A user may deflect tab 192 to move teeth 194 and 134 out of engagement with one another (e.g., on different planes) (as shown in FIG. 13, which shows tab 192 being deflected downward), thus enabling arm 132 (and side wall 130 in engagement therewith) to move (e.g., slide) towards and away from base 110 into a desired position. When a user releases tab 192, teeth 194 and 134 may move into alignment with one another (a small amount of tweaking may be necessary for ideal alignment) and functions to lock side walls 130 in position with respect to base 110. As can be appreciated, each side wall 130 may be positioned independently of (and at a different distance from base 110) the other side wall 130. Further, at least one side wall 130 may be removed from base 110 if it not desired for a particular application. Additionally, more than one locking mechanisms 190 may be provided on each side of base 110.

As shown in FIGS. 2-4, 7, 8, 11 and 12, indicia may be included on tab 192 and/or arm 134. In the illustrated embodiment, tab 192 includes user instructions, i.e., "push to adjust width." Other types of indicia are also contemplated. Arms 134 are shown having indicia relating to distance (e.g., inches or centimeters). Further, other indicia including the name of particular products may be displayed on arm 134, for example to facilitate setting up product display tray 100 to accommodate a particular product. For instance, "frozen spinach," frozen carrots," "pizza," etc. may be displayed on arm 134 to correspond with to a desired location of side walls 130 to create a desired width of product display tray 100 to hold a particular product.

Figure 14:
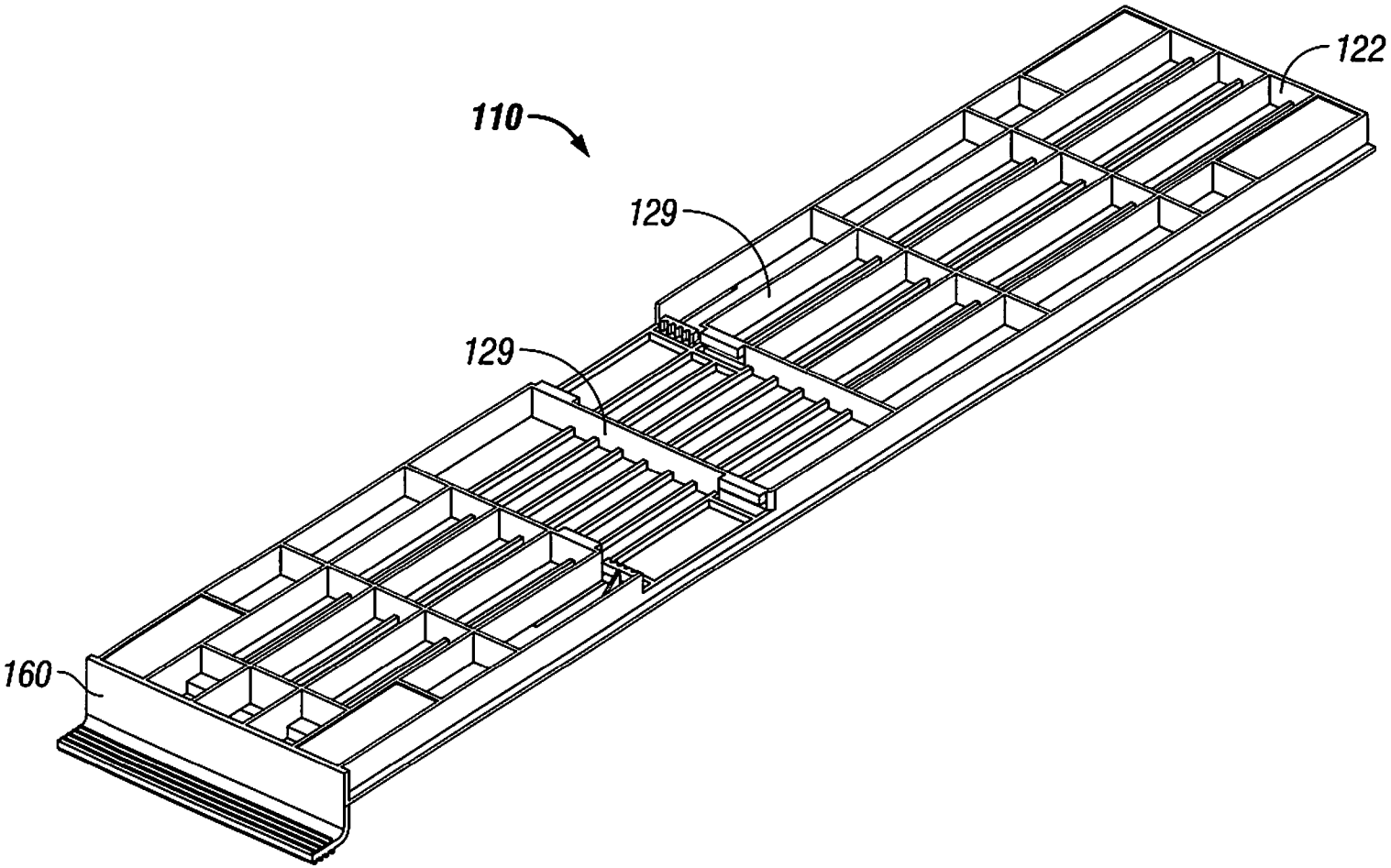
FIG. 14 illustrates a perspective view of a lower surface of a product display tray in accordance with an embodiment of the present disclosure.

FIG. 14 illustrates lower surface 120 of base 110 according to an embodiment of the present disclosure. In this embodiment, lower surface 120 includes a plurality of beams 129 disposed thereon, or adjacent thereto in a substantial grid-like pattern. It is envisioned that beams 129 help strengthen base 110, thus facilitating the transportation of a fully-loaded product display tray 100 without damaging base 110. It is also envisioned that beams 129 are situated to allow for at least one arm 134 to properly function, as described above.

Figure 15:
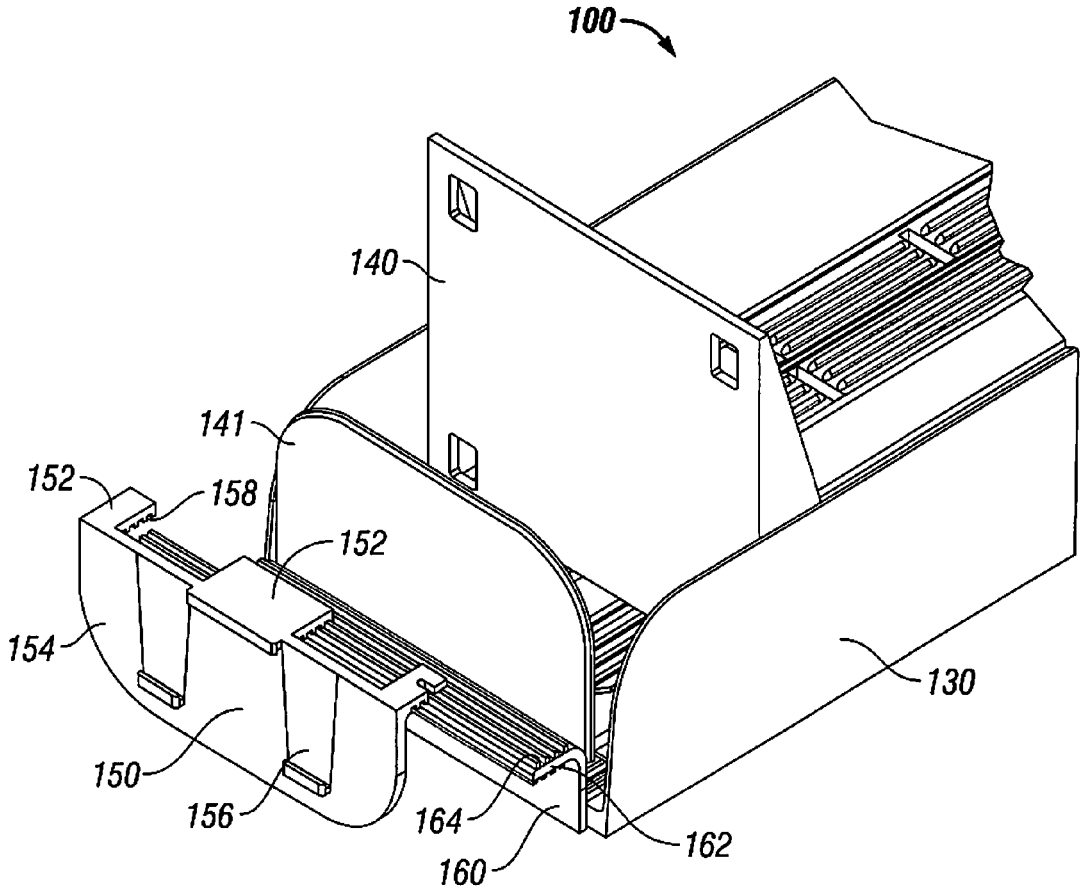
FIGS. 15-17 illustrate a product display tray having an adjustable handle in accordance with an embodiment of the present disclosure.
Figure 16:
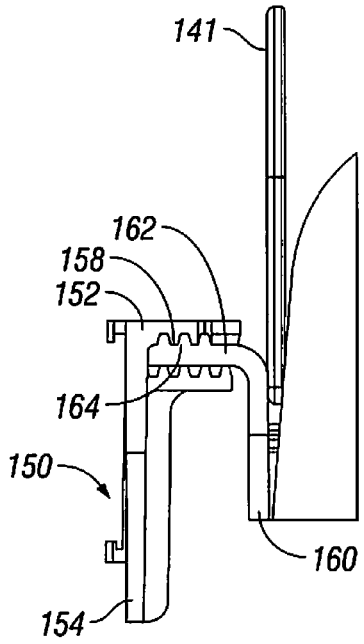
Figure 17:
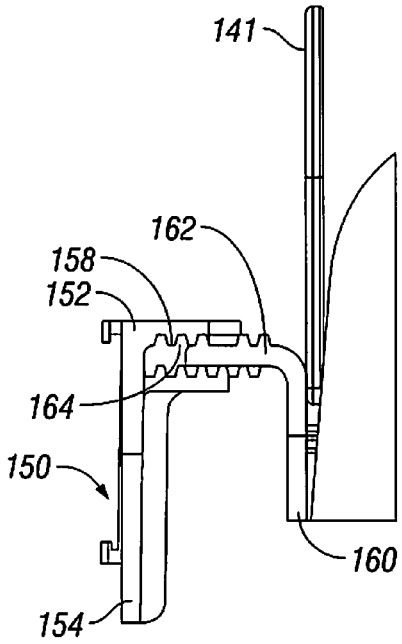

With reference to FIGS. 15-17, an embodiment of handle 150 is shown. Handle 150 in this embodiment is adjustable. More specifically, the distance between vertical portion 154 and base lip 160 is adjustable. As can be appreciated, having an adjustable handle 150 enables product display tray 100 to fit on shelves 200 having different sized (e.g., thickness) shelf lips 210. Handle 150 is slidable with respect to a horizontal portion 162 of base lip 160 (FIG. 15) and it is envisioned that a user may slide handle 150 far enough towards a side of base lip 160 to remove handle 150 therefrom.

In the illustrated embodiment, plurality of grooves 158 is formed on horizontal portion 152 of handle 150, where at least one groove 158 is configured to engage at least one valley 164 on horizontal portion 162 of base lip 160 (a plurality of valleys is shown). As such, handle 150 may be removed from base lip 160 and repositioned to alter the size of the space between vertical portion 154 and base lip 160. FIG. 16 illustrates a relatively small space between vertical portion 154 and base lip 160 and FIG. 17 shows a larger space. Additionally, it is envisioned that handle 150 is able to lock in place on base lip 160.

Figure 18:
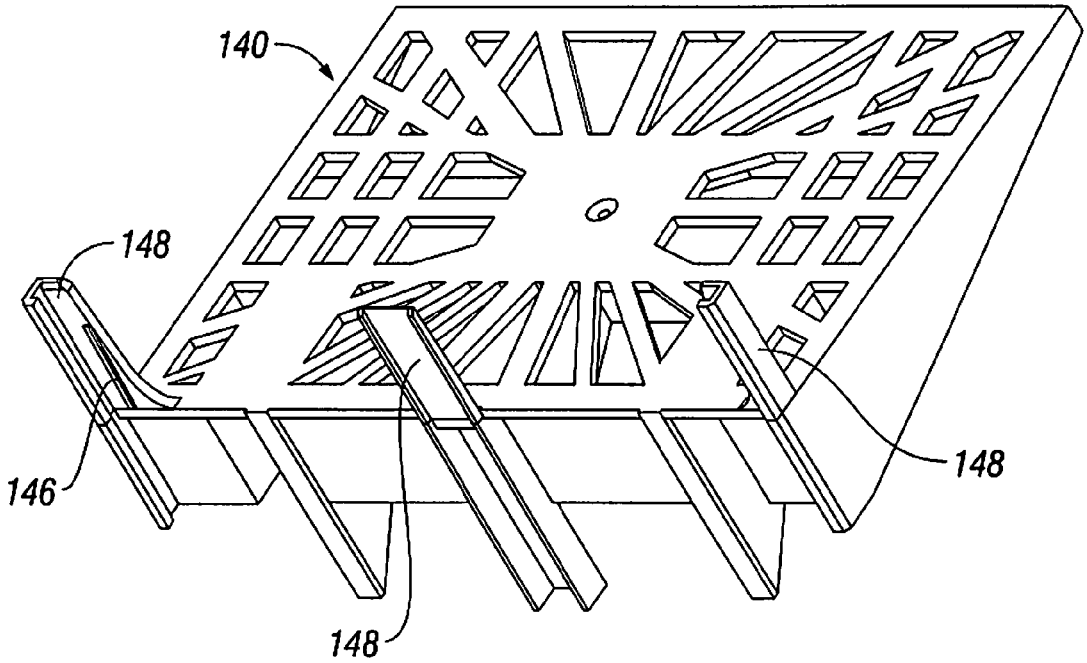
FIG. 18 illustrates a perspective view of a pusher for use with a product display tray in accordance with an embodiment of the present disclosure.

FIG. 18 illustrates an embodiment of pusher 140 in accordance with an embodiment of the present disclosure. Pusher 140 of this embodiment includes a pusher rib 146 disposed beneath a pusher leg 148. Pusher leg 148 (three of which are shown) may be configured to slide at least partially within a track (e.g., track 144) of base 110 to help align pusher 140, for example. To further align pusher 140 and to help maintain pusher 140 on base 110, pusher rib 146 is configured to fit and/or slide within a corresponding channel 128 of base 110.

It will be understood that various modifications may be made to the embodiments disclosed herein. For example, it is contemplated that other methods and structure for adjusting and/or locking side walls 130 and/or arms 132 may be included without departing from the scope of the present disclosure. Additionally, the biasing element(s) 142 may be disposed distally of pusher 140. Further, shape and size of notch 180 is not limited to what is shown in the illustrated embodiment, as notches of other shapes and/or sizes may be included to engage shelf lips 210 of different sizes. Still further, more than one notch 180 may be included on base 110 and/or side wall 130. Therefore, the above description should not be construed as limiting, but merely as exemplifications of various embodiments. Those skilled in the art will envision other modifications within the scope and spirit of the claims appended hereto.

What is claimed:

1. A product display tray configured for use on a shelf, comprising:

a base including a front end, a back end, and an upper surface for supporting items and defining a longitudinal axis extending between the front end of the base and the back end of the base;

a base lip disposed adjacent the front end of the base; and a handle disposed in mechanical cooperation with the base lip and defining a gap therebetween, wherein the size of the gap is adjustable along the longitudinal axis between a plurality of discreet positions; wherein at least a majority of the handle extends below the base lip, and wherein a cross-section of the handle is substantially L-shaped.

2. The product display tray of claim 1, wherein the size of the gap is adjustable in part by sliding the handle relative to the base lip in a direction that is substantially transverse to the longitudinal axis.

3. The product display tray of claim 1, wherein the handle includes a substantially horizontal portion and a substantially vertical portion, the substantially horizontal portion including downwardly depending grooves for engaging the base lip, at least a majority of the substantially vertical portion depending downwardly from the substantially horizontal portion.

4. The product display tray of claim 1, further comprising a plurality of beams disposed adjacent a lower surface and wherein the beams form a substantial grid-like pattern.

5. The product display tray of claim 1, wherein at least one of the base and a side wall of the base includes a notch thereon.

6. The product display tray of claim 5, wherein the notch is disposed distally of the front end of the base.

7. The product display tray of claim 1, wherein the base includes a plurality of ribs thereon, the ribs extending at least partially between the front end and the back end and being raised above the upper surface.

8. The product display tray of claim 7, wherein adjacent ribs form a channel therebetween, the channel being configured to direct liquid towards at least one of the front end and the back end of the base.

9. The product display tray of claim 1, further comprising a pusher disposed at least partially above the upper surface, the pusher being biased towards the front end of the base.

10. The product display tray of claim 9, wherein the pusher is biased towards the front end of the base via at least one spring.

11. The product display tray of claim 9, further including a glide rib disposed on the pusher, the glide rib configured to slide at least partially within a channel on the upper surface of the base.

12. The product display tray of claim 1, wherein the size of the gap is adjustable between a plurality of distinct sizes.

13. The product display tray of claim 1, wherein the size of the gap is adjustable along the longitudinal axis by initially sliding the handle in a first direction that is substantially transverse to the longitudinal axis and next by sliding the handle in a second direction, the second direction being opposite the first direction.

* * * * *